US005755625A

United States Patent [19]

Jackson

[11] Patent Number: 5,755,625

[45] Date of Patent: May 26, 1998

[54] HAND(S) ALIGNED GOLF PUTTER

[76] Inventor: Carl H. Jackson, 22 Clinton Ave., Westport, Conn. 06880

[21] Appl. No.: 794,373

[22] Filed: Feb. 4, 1997

[51] Int. Cl.[6] ..... A63B 53/02

[52] U.S. Cl. ..... 473/314; 473/313; 473/340

[58] Field of Search ..... 473/313, 314, 473/340; D21/214, 217

[56] References Cited

U.S. PATENT DOCUMENTS

| | | | |
|---|---|---|---|
| D. 257,050 | 9/1980 | Cicero | 473/314 X |
| 1,631,504 | 6/1927 | Redman | 473/313 |
| 2,478,468 | 8/1949 | Drake | 473/313 |
| 3,448,981 | 6/1969 | Anweiler | 473/314 |
| 3,519,271 | 7/1970 | Smith | 473/314 |
| 3,574,349 | 4/1971 | Kropp | 473/340 X |
| 5,224,702 | 7/1993 | Turner | 473/314 |
| 5,382,019 | 1/1995 | Sneed | 473/314 X |
| 5,573,468 | 11/1996 | Baumann | 473/313 X |
| 5,595,385 | 1/1997 | Jablonski | 473/314 X |
| 5,616,087 | 4/1997 | Bothwell | 473/313 X |

*Primary Examiner*—Raleigh W. Chiu
*Attorney, Agent, or Firm*—Vincent J. Vasta, Jr.

[57] ABSTRACT

The present invention concerns a putter used in the game of golf. Specifically, the putter of the present invention is designed so that the sweet spot on the clubhead is generally aligned with the golfer's hand(s) when positioned at the top of the shaft, for a short shafted putter, and the center of the shaft, for a long shafted putter. The basic design requires a shaft which is affixed toward the toe end of the clubhead. The overall configuration of the golf putter of the present invention promotes a golfswing in which the sweet spot and the golfer's hand(s) travel together along the target line, thereby creating a straight putting stroke.

14 Claims, 4 Drawing Sheets

HAND(S) ALIGNED GOLF PUTTER

FIELD OF THE INVENTION

The present invention relates to a putter used in the game of golf. Specifically, the putter of the present invention is designed so that the sweet spot on the clubhead is generally aligned with the golfer's hand(s) when positioned at the top of the shaft, for a short shafted putter, and the center of the shaft, for a long shafted putter. The basic design requires a shaft which is affixed toward the toe end of the clubhead. The overall configuration of the golf putter of the present invention promotes a golfswing in which the sweet spot and the golfer's hand(s) travel together along the target line, thereby creating a straight putting stroke.

BACKGROUND OF THE INVENTION

A golfer will typically use a putter when standing on the putting green. A putter is generally composed of a clubhead and a shaft which are connected.

The relevant parts of the clubhead are the: (a) clubface (makes contact with the golf ball), (b) toe (end of clubhead furthest from the golfer at address), (c) heel (end of clubhead nearest to golfer at address), (d) sole (bottom of clubhead).

The clubhead may be of three general types: (i) the straight blade which has a thin, light weight head, (ii) the flange blade which has a straight blade with an extension added to the back of the clubface to increase its mass, and (iii) the mallet head which has a large clubhead generally shaped like a half moon or a block. The clubface is angled from the ground 0° to 10° (Loft). The length of the clubhead from the toe to the heel is generally 4".

Each clubhead has a sweet spot. The "sweet spot" is the area on the clubhead, on either side of which, the mass is equal. For most clubheads, the sweet spot is located near the center of the clubhead. Golfers will usually attempt to make contact with the golf ball at the sweet spot in order to promote a straight trajectory when the ball leaves the clubface.

The putter shaft is a generally straight pole shaped object with an approximate ¼" to ¾" diameter which is typically wider at the top and tapers toward the bottom where the shaft is attached to the clubhead. Typically, shafts are affixed to the clubhead at either the center or towards the heel in various golf clubs of the prior art.

Under current United States Golf Association ("USGA") rules, the shaft need not be straight for a 5" portion, measured along the axis of the shaft from the sole of the clubhead to the point (measuring all bends) at which the shaft needs to become straight. Also, according to USGA rules, (i) the length of the putter shaft must be at least 18" from the top of the shaft measured along the straight axis to the sole of the clubhead, (ii) the shaft may be fixed to any point on the clubhead, (iii) the projection of the straight part of the shaft onto the vertical line which runs directly down through the centerline of the clubhead must diverge from the vertical by at least 10°, and (iv) the projection of the straight part of the shaft onto the vertical plane along the intended line of play must not diverge from the vertical by more than 20°.

A grip, which is generally made of rubbery or leather material, is generally wrapped around the shaft to assist the golfer in holding the putter.

There are generally two types of putters: (i) the traditional putter ("Traditional Putter") and (ii) the long putter ("Long Putter").

The Traditional Putter has a relatively short shaft (approx. 18"–37") and one grip at the top of the shaft. The shaft is typically affixed toward the heel or the center of the clubhead. When putting with the Traditional Putter, the golfer holds the grip with both hands generally opposite to one another and bends at the waist. The golfer looks down the target line toward the hole by rotating his head and pointing his chin toward the hole.

The Long Putter has a long shaft (approx. 37"–55") and two grips, with the first grip positioned at the top of the shaft and the second positioned towards the center of the shaft. The length of the shaft allows the golfer to stand relatively upright at address. The shaft of the Long Putter is typically affixed near the center of the clubhead. The Long Putter usually has a heavier clubhead and a stiffer shaft than a Traditional Putter.

In one preferred embodiment the long shated putter of the present invention helps the golfer to create a pendulum-like putting stroke. The pendulum motion is attained by having the golfer hold the shaft at two different places, one hand at the top of the shaft and the other more toward (but above) the center of the shaft.

By holding the top of the shaft stationary and moving the lower portion of the shaft away from the ball on the backswing, the force of gravity pulls the clubhead back towards the ball on the downswing. For Long Putters with a clubhead which has a rounded sole, the pendulum motion is improved if the golfer rolls the clubhead onto its toe, thereby aligning the golfer's hands and the straight part of the shaft directly over the sweet spot.

In contrast to the prior art golf clubs, the golf putter of the present invention has the following characteristics: The shaft of the golf putter according to the present invention is affixed to the golf head at the toe end; the golf putter of the present invention is affixed to the golf head at a slight angle so as to create alignment between the handgrip point on the shaft at the top for a short shafted putter and at the center for a long shafted putter, and the sweet spot on the club head; the club putter of the present invention may have a marking on the shaft at the point where the golfer's hand(s) should be placed in order to affect the general alignment of the golfer's hand(s) with the sweet spot on such club head.

There are no prior art references which are known to the inventor which are relevant to the invention disclosed and claimed in this application.

It is, therefore, an object of the present invention to provide for a novel golf putter in which the sweet spot is generally aligned with the golfer's hand(s).

It is a further object of the present invention to provide for a golf putter which has been designed in such a way that the shaft is affixed toward the toe end of the golf club head.

Lastly, it is an object of the present invention to provide for a golf putter which promotes a golf swing in which the sweet spot and the golfer's hand(s) travel together along the target line, thereby creating a straight putting stroke.

These and other objects of the invention will become apparent from the following discussion of the invention.

SUMMARY OF THE INVENTION

The present invention provides for a putter used in the game of golf. Specifically, the putter of the present invention is designed so that the sweet spot on the clubhead is generally aligned with the golfer's hand(s) when positioned at the top of the shaft, for a short shafted putter, and the center of the shaft, for a long shafted putter. The basic design requires a shaft which is affixed toward the toe end of the clubhead. The overall configuration of the golf putter of the present invention promotes a golfswing in which the sweet spot and the golfer's hand(s) travel together along the target line, thereby creating a straight putting stroke.

The construction and obvious advantages of the system provided for by the present invention will be more clearly understood from the following description of the various specific embodiments when read in conjunction with the accompanying drawings.

BRIEF DESCRIPTION OF THE DRAWINGS

FIG. 3(*b*) is a schematic representation of an alternative arrangement for the point of attachment between the golf club shaft and the clubhead.

FIG. 3(*c*) is a schematic representation of another alternative arrangement for the point of attachment between the golf club shaft and the clubhead.

FIG. 3(*d*) is a schematic representation of another alternative arrangement for the point of attachment between the golf club shaft and the clubhead.

FIG. 3(*e*) is a schematic representation of another alternative arrangement for the point of attachment between the golf club shaft and the clubhead.

DETAILED DESCRIPTION OF THE INVENTION

The golf putter of the present invention has several unique parameters which generally serve to align the golfer's hand (s) over, or offset behind or in front of, the sweet spot of the clubhead. The design parameters of the present invention do not require a clubhead with a rounded sole to create this alignment.

The alignment which is necessary to properly effectuate the utilization of the golf putter of the present invention is created in the following way: (i) the straight part of the shaft (along its axis) will point at or beyond the toe of the clubhead, (ii) the angle of the shaft will intersect the vertical line running straight down through the sweet spot by at least a 10° angle, (iii) the shaft's length and position, and the clubhead's length and distribution of mass, will be determined so that the golfer's hand(s) positioned at the top of the shaft, for a short shafted putter, and the center of the shaft, for a long shafted putter, will be generally aligned over the sweet spot. This alignment will be offset if the clubshaft is set slightly forward of and is angled more than 0° toward or away from the golf hole along the target line (maximum 20°).

Figure 1:
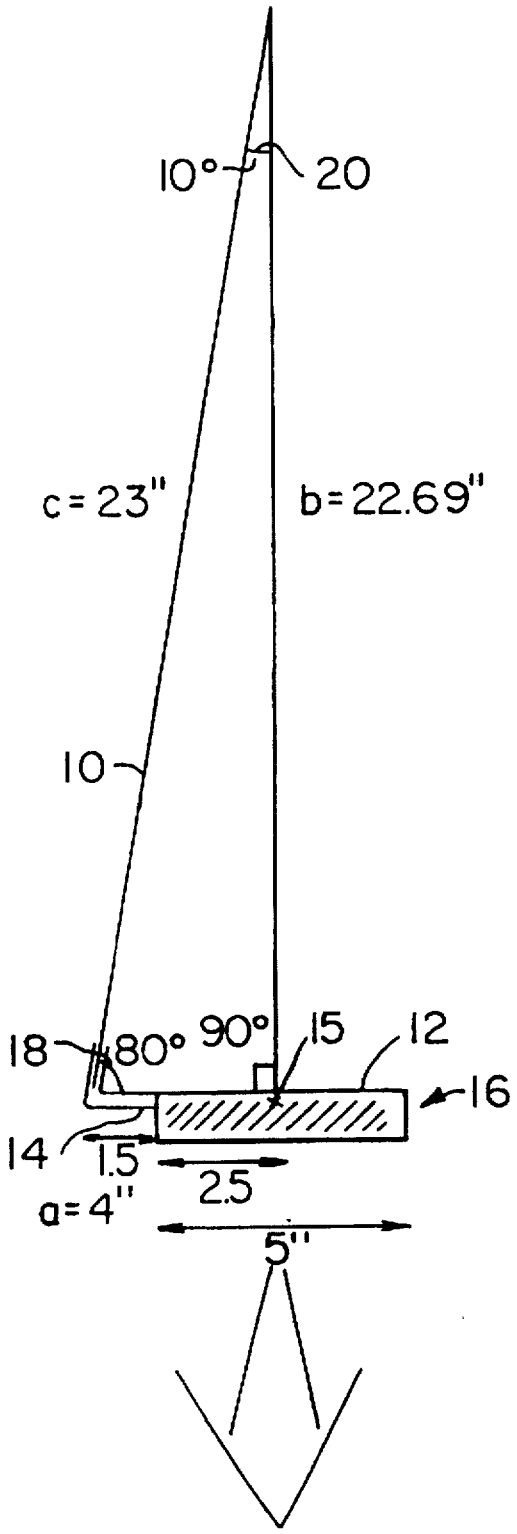
FIG. 1 is a schematic representation of the angular relationships between the shaft axis and the clubhead of the golf club of the present invention.

With reference to FIG. 1, a schematic representation of the angular relationships between the shaft axis and the clubhead which determines the location of the grip point relative to the sweet spot on the face of the group head, for purposes of alignment is depicted.

Figure 4:
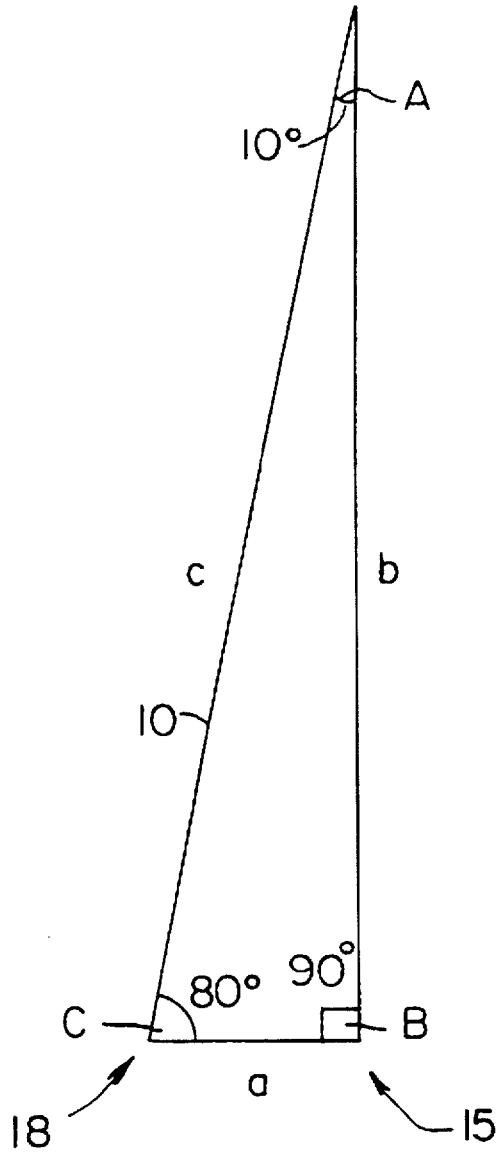
FIG. 4 is a diagram representing the relationship between angles and lengths relevant to the design of the golf club of the present invention.

The relationship between the various elements are determined by the following: The formulae for determining the sides of a triangle when angles are known, and the length of one side is known, are as follows:

With reference to FIG. 4;

a=base of triangle (known)

b=other leg c=hypotenuse

When a is known, b and c may be computed according to the equation:

$$b=a(\sin \text{Angle C}/\sin \text{Angle A})$$

$$c=a(\sin \text{Angle B}/\sin \text{Angle A})$$

All angles of a triangle must add up to 180 degrees.

When

Angle A=10 degrees

Angle B=90 degrees

Angle C=80 degrees

Then $b=a\times 0.98481/0.17365$ $b=a\times 5.671$ $c=a\times 1/0.17365$ $c=a\times 5.759$ In order to generally align the sweet spot with the golfer's hand(s) as described above, the following measurements must be known: (i) the length of the straight line parallel to the ground, as measured from the point where the straight part of the shaft ends, referred to as the "Shaft Point", to the point which is directly above, at, or on either side of the sweet spot, such point referred to as the "Sweet Spot Point" and such length, the "Sweet Spot Length",and (ii) two of the angles of the 90° triangle for which the Sweet Spot Length is the base. The top of the shaft, for a short shafted putter, and the center of the shaft, for a long shafted putter, where the golfer places his hand(s), are designed to be at the point where the two legs, other than the base, of such 90° triangle intersect above the Sweet Spot Point.

The height at which the two legs of the 90° triangle intersect above the Sweet Spot Point will vary depending upon the Sweet Spot Length and the angle at which the shaft intersects the straight line running directly down through the sweet spot. In addition, such point may not be directly above the sweet spot if the alignment of the shaft is set slightly forward or is angled more than 0° toward or away from the golf hole along the target line.

With reference to FIG. 1, which shows a schematic representation of the angular relationship between the shaft axis 10, the golf club head 12, the sweet spot 15, wherein the said golf club head has a toe end 14 and a heel end 16 and, in such representation, the shaft 10 is affixed at an angle to the toe end 14 of the golf club head 12 which forms an angle 18 at that point and, in which relationship, the angle 20 is formed by the intersection of the axis of the shaft and a vertical line drawn perpendicular to the sweet spot point 15.

By way of example, with reference to FIG. 1, if the sweet spot is 2.5" from the toe of the clubhead, and the straight part of the shaft ends at a point which is 1.5" beyond the toe of the clubhead, then the Sweet Spot Length, and the base of the 90° triangle, will equal 4" (2.5"+1.5"). Therefore, the golfer's hand(s) positioned at the top of the shaft, for a short shafted putter, and the center of the shaft, for a long shafted putter, when the shaft is angled 10° from the vertical, will be aligned at a point which is 22.69" above the Sweet Spot Point. Given this example, the Long Putter would have a shaft length, the straight part of which would equal 46.72" (2×23.036").

This is by way of example only and these parameters may vary depending upon the golfer's personal preference, height and arm length, and whether the putter is to be used like a Traditional Putter, Long Putter, or in a modified croquet style, where the golfer stands alongside the target line and faces the hole at address.

Regardless of the actual measurements, the straight part of the shaft will always point at or beyond the toe of the clubhead, and the golfer's hand(s) positioned at the top of the shaft, for a short shafted putter, and the center of the shaft, for a long shafted putter, will always be aligned over the Sweet Spot Point.

Figure 2:
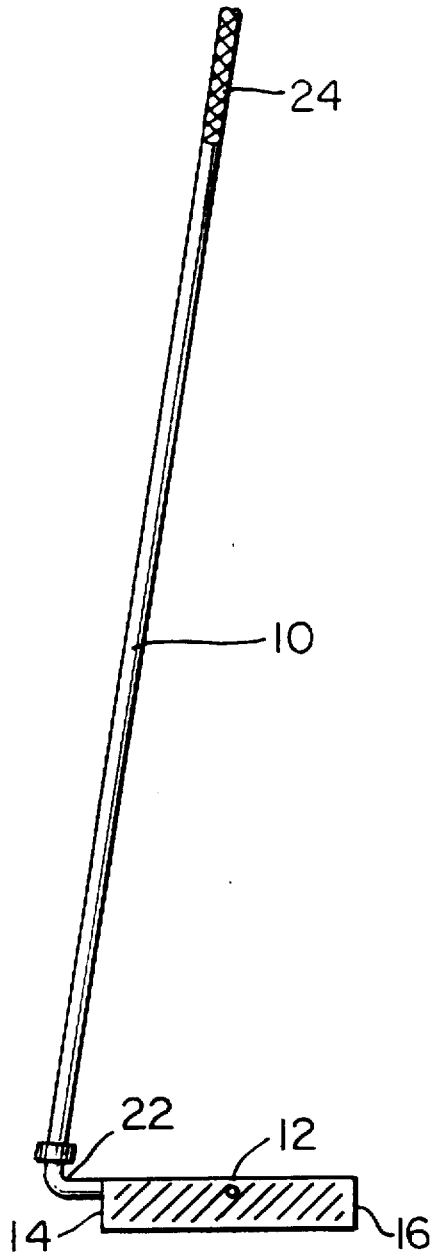
FIG. 2 is a schematic representation of a typical golf putter of the present invention in front elevation view.
Figure 3A:
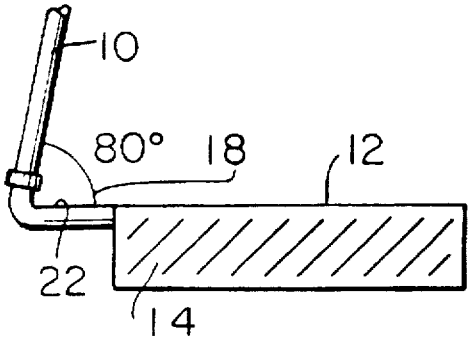
FIG. 3(*a*) is a schematic representation of one arrangement showing the point of connection between the golf club shaft and the clubhead.
Figure 3B:
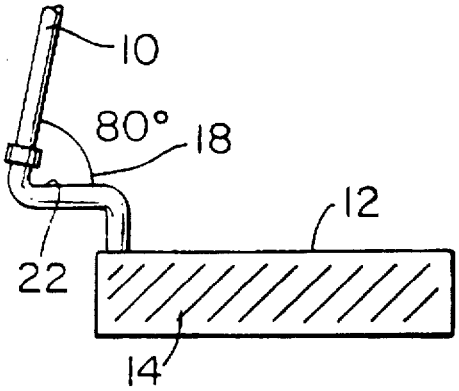
Figure 3C:
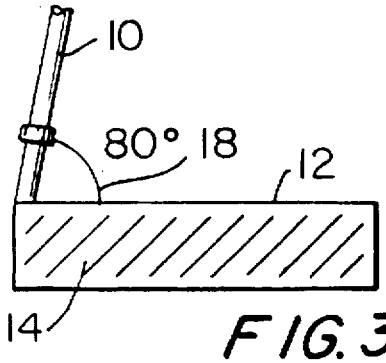
Figure 3D:
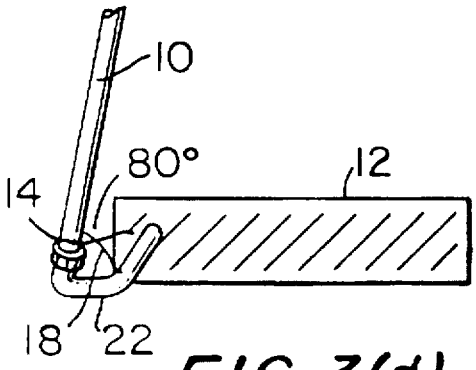
Figure 3E:
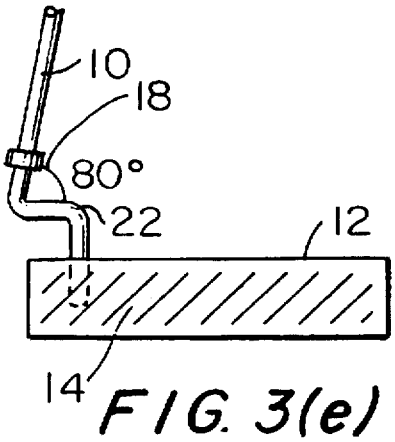

With reference to FIG. 2, a schematic representation of a typical golf putter of the present invention is shown depicting the shaft 10, the golf club head 12, having a toe end 14, and a heel end 16, an angled connector 22, connecting the shaft to the toe end of the club head. The shaft is also provided with a grip means 24, for grasping the club by the golfer.

With reference to FIG. 3(*a*), a schematic representation of one arrangement showing the point of connection between the golf club shaft and the club head is depicted showing the shaft 10, the golf club head 12, the angular connection 22, affixed to the toe end 14.

With reference to FIG. 3(*b*), a schematic representation of an alternative arrangement showing the point of attachment between the golf club shaft and the club head according to the present invention is depicted showing the shaft 10, the club head 12, an offset angular connector 22 attached to the top of the heel end 14 of the clubhead, With reference to FIG. 3(*c*), a schematic representation of another alternative arrangement with a point of attachment between the golf club shaft and the clubhead is depicted showing the shaft 10, which is directly connected to the top of the clubhead 12, and the heel end 14.

With reference to FIG. 3(*d*), a schematic representation of another alternative arrangement with a point of attachment between the golf club shaft is depicted showing the shaft 10, the clubhead 12, an offset angular connector 22, which is attached to the front face of the golf club head at the heel end 14.

With reference to FIG. 3(*e*), a schematic representation of another alternative arrangement with the point of attachment between the golf club shaft and the club is depicted showing the shaft 10, the club head 12, an offset angular connector 22 attached to the backside of the clubhead at the heel end 14.

The materials of construction of the various elements which constitute the golf putter according to the present invention are not critical insofar as the invention is concerned except for the fact that such materials of construction will be selected from those materials which have been found to be generally acceptable and preferable in the construction of golf clubs.

Therefore, it is anticipated that the shaft of the golf putter according to the present invention will be constructed from a generally typically used material which may be either an alloyed metal or a molded engineered plastic reinforced material or other similarly acceptable material used in the construction of golf club shafts in the art.

The head of the golf putter according to the present invention may be constructed from a number of different materials including all of those materials which have become generally acceptable for construction of golf club heads in the art. It is anticipated the golf club head of the golf putter according to the present invention will be fabricated from a steel or aluminum alloy or a laminated material comprising a steel or aluminum alloy face and a composite material affixed to the back thereof which is either a molded composite or a metal alloy material.

The angular connector which in some embodiments, forms the attachment means between the end of the shaft and the heel end of the golf club head in the putter arrangement of the present invention may be constructed from a number of different materials which allow for the formation of the necessary angle and/or offset required to form the particular connection desired. Typically this component will be fabricated using a high strength steel or aluminum alloy material to enable it to withstand the various stresses which will have to be endured by the golf putter in the course of normal use.

It will be further apparent to one skilled in this art that the improvements provided for in the present invention, while described with relation to certain specific physical embodiments also lend themselves to being applied in other physical arrangements not specifically provided for herein, which are nonetheless within the spirit and scope of the invention taught here.

I claim:

1. A golf putter comprising an elongated shaft and a handle, wherein the shaft and handle are co-linear, and wherein the shaft may be either a long shaft or a short shaft, and further comprising a golf club head, said golf club head having a face and a toe end, wherein the angle which the longitudinal shaft axis forms with the vertical axis of the club face is such that the point at which the golfer grips the angled shaft is generally aligned directly above the sweet spot on the club face, wherein;

the sweet spot on the face is approximately 2.5 inches from the toe of the club head; the straight part of the connecting shaft ends at a point which is 1.5 inches beyond the toe of the club head, the shaft is positioned at an angle of 10 degrees from the vertical axis of the club head and the golfer's hand(s) are positioned at a point which is 22.69 inches above the sweet spot point on the club face, when the golf putter is a short shafted putter and, one of the golfer's hands is positioned at a point which is 22.69" above the sweet spot on the club face and the other hand is positioned at the end of the shaft, when the golf putter is a long shafted putter.

2. A golf putter according to claim 1 wherein the end of the shaft is connected to the toe of the club head by means of an angled offset transition connector.

3. A golf putter according to claim 1 wherein the end of the shaft is connected directly to the toe of the club head.

4. A golf putter according to claim 1, wherein the end of the shaft is connected to the toe of the club head by means of an offset transitional connecting means which is attached to the face of the golf club head at the toe end.

5. The use of a golf club putter according to claim 1, wherein the golfer;s hand(s) grasp the golf club shaft at a point immediately over the sweet spot in the club face which allows the said golfer to naturally position himself over the target line at the address to the ball and to have a direct view along the target line.

6. The use of a golf club putter according to claim 1, wherein the golfer's hand(s) grasp the golf club shaft at a point immediately over the sweet spot in the club face wherein the said golfer moves his hand(s) and the sweet spot together along the target line, thus promoting a straight backswing and follow through in the golfer's stroke.

7. The use of a golf club putter according to claim 1, wherein the golfer's hand(s) grasp the golf club at two different places, one at the top of the shaft and the other at a point at or near the center of the shaft and, while holding the top of the shaft stationary, moves the lower portion of the shaft away from the ball on the backswing, and allows the force of gravity to pull the clubhead back towards the ball on the downswing.

8. A golf putter comprising an elongated shaft and handle, wherein the shaft and handle are co-linear, and further comprising a golf club head, said golf club head having a face and a toe end, wherein the angle which the longitudinal shaft axis forms with the vertical axis of the club face is such that at least one point at which the golfer grips the angled shaft is generally aligned directly above the sweet spot on the club face, wherein;

the shaft is attached to the club head at the toe end only, and the alignment of said golf putter is effected by forming an angle between the axis of the shaft and a vertical line running straight through the sweet spot of at least 10° which will be determined by locating the preferred position for the golfer's hands on the said golf club by locating the point on the shaft which will be generally aligned over the sweet spot.

9. A golf putter according to claim 8 wherein the end of the shaft is connected to the toe of the club head by means of an angled offset transition connector.

10. A golf putter according to claim 8 wherein the end of the shaft is connected directly to the toe of the club head.

11. A golf putter according to claim 8 wherein the end of the shaft is connected to the toe of the club head by means of an offset transitional connecting means which is attached to the face of the golf club head at the toe end.

12. The use of a golf club putter according to claim 8, wherein the golfer's hand(s) grasp the golf club shaft at a point immediately over the sweet spot in the club face which allows the said golfer to naturally position himself over the target line at the address to the ball and to have a direct view along the target line.

13. The use of a golf club putter according to claim 8, wherein the golfer's hand(s) grasp the golf club shaft at a point immediately over the sweet spot in the club face wherein the said golfer moves his hand(s) and the sweet spot together along the target line, thus promoting a straight backswing and follow through in the golfer's stroke.

14. The use of a golf club putter according to claim 8, wherein the golfer's hand(s) grasp the golf club at two different places, one at the top of the shaft and the other at a point at or near the center of the shaft and, while holding the top of the shaft stationary, moves the lower portion of the shaft away from the ball on the backswing, and allows the force of gravity to pull the clubhead back towards the ball on the downswing.

* * * * *